US010094056B2

(12) United States Patent
Schwarzberger

(10) Patent No.: US 10,094,056 B2
(45) Date of Patent: Oct. 9, 2018

(54) AUTOMATIC THREAD TENSIONING

(71) Applicant: ABM International, Inc., The Woodlands, TX (US)

(72) Inventor: Neal A. Schwarzberger, The Woodlands, TX (US)

(73) Assignee: ABM International, Inc., The Woodlands, TX (US)

( * ) Notice: Subject to any disclaimer, the term of this patent is extended or adjusted under 35 U.S.C. 154(b) by 735 days.

(21) Appl. No.: 14/497,438

(22) Filed: Sep. 26, 2014

(65) Prior Publication Data

US 2016/0090675 A1 Mar. 31, 2016

(51) Int. Cl.
*D05B 47/00* (2006.01)
*D05B 47/04* (2006.01)
*D05B 11/00* (2006.01)

(52) U.S. Cl.
CPC ..... *D05B 47/04* (2013.01); *D05B 11/00* (2013.01)

(58) Field of Classification Search
CPC ..... D05B 47/04; D05B 47/00; D05B 47/02; D05B 47/06; D05B 11/00
See application file for complete search history.

(56) References Cited

U.S. PATENT DOCUMENTS 3,797,426 A * 3/1974 Von Hagen ..... D05B 47/00 112/254
4,254,723 A * 3/1981 Rothstein ..... D05B 47/04 112/255
4,289,087 A * 9/1981 Takenoya ..... D05B 47/00 112/254
4,452,156 A * 6/1984 Teetz ..... D05C 11/08 112/255
4,884,763 A * 12/1989 Rydborn ..... B65H 63/0327 242/148
4,998,491 A * 3/1991 Hanyu ..... D05B 47/04 112/243
5,001,997 A 3/1991 Wang
5,156,105 A 10/1992 Wang
(Continued)

FOREIGN PATENT DOCUMENTS

EP 0783049 A1 7/1997
EP 1288363 A2 3/2003
(Continued)

OTHER PUBLICATIONS

Website: http://www.barudanamerica.com/index/tech-support/technical-information . . . (Jun. 26, 2013) 1 page.
(Continued)

*Primary Examiner* — Nathan Durham
(74) *Attorney, Agent, or Firm* — Timothy W. Menasco, Esq.; Brian B. Shaw, Esq.; Harter Secrest & Emery LLP

(57) ABSTRACT

A system and method are provided for selectively controlling a thread tension in a quilting machine. The thread tensioner is moveable to a reduced tension configuration in response to an actuator, wherein the actuator is sized to be located within an existing form factor. A controller can be connected to the actuator to regulate the thread tension in response to a sewing translation and a non-sewing translation of the sewing head relative to a workpiece.

14 Claims, 9 Drawing Sheets

(56) References Cited

U.S. PATENT DOCUMENTS

| | | | | |
|---|---|---|---|---|
| 5,611,499 | A * | 3/1997 | Stokes | B65H 59/225 242/150 R |
| 5,826,526 | A | 10/1998 | Tomita | |
| 5,860,376 | A | 1/1999 | Tseng | |
| 6,012,405 | A * | 1/2000 | Melton | D05B 19/12 112/254 |
| 6,055,920 | A * | 5/2000 | Hori | D05B 47/04 112/254 |
| 6,089,172 | A * | 7/2000 | Takenoya | D05B 19/12 112/254 |
| 6,123,040 | A | 9/2000 | Hayakawa et al. | |
| 6,145,456 | A | 11/2000 | Codos | |
| 6,170,414 | B1 | 1/2001 | Kaetterhenry et al. | |
| 6,595,150 | B2 * | 7/2003 | Yamazaki | D05B 47/04 112/254 |
| 6,983,192 | B2 | 1/2006 | Block et al. | |
| 7,124,697 | B2 * | 10/2006 | Foley | D05B 47/04 112/255 |
| 7,308,333 | B2 | 12/2007 | Kern et al. | |
| 7,770,530 | B2 | 8/2010 | James et al. | |
| 8,073,561 | B2 | 12/2011 | Hirose | |
| 8,074,590 | B2 | 12/2011 | Bentley | |
| 8,170,708 | B2 | 5/2012 | Goldman et al. | |
| 8,245,656 | B2 | 8/2012 | Mori et al. | |
| 8,448,588 | B1 * | 5/2013 | Lindley | D05B 47/06 112/254 |
| 2006/0137476 | A1 | 6/2006 | Bull et al. | |
| 2007/0221106 | A1 | 9/2007 | Nishida et al. | |
| 2012/0055386 | A1 | 3/2012 | Bentley | |
| 2012/0210924 | A1 | 8/2012 | Kawai | |

FOREIGN PATENT DOCUMENTS

| | | | |
|---|---|---|---|
| EP | 1375723 | A2 | 1/2004 |
| EP | 1816248 | A1 | 8/2007 |
| EP | 2444538 | A1 | 4/2012 |
| EP | 2522767 | A1 | 11/2012 |
| JP | 2800976 | B2 | 12/1990 |
| WO | 8503093 | A1 | 7/1985 |
| WO | 2008146537 | A1 | 12/2008 |

OTHER PUBLICATIONS

Website: http://www.longarmsupplies.net/rotarytensiondisc.aspx (Jun. 28, 2013) 2 pages.

Website: http://www.longarmpro.com/shop/Parts/p/Standard-Rotary-Tension-Assembly.htm (Jun. 28, 2013) 1 page.

Website: http://www.boersmas.com/index/php?option+com_content&task_view&id_77 (Jun. 28, 2013) 5 pages.

Website: http://www.threadsmagazine.com/item/4302/understanding-thread-tension/page/all (Jul. 28, 2014) 11 pages.

* cited by examiner

AUTOMATIC THREAD TENSIONING

BACKGROUND OF THE INVENTION

Technical Field

The present disclosure generally relates to sewing or quilting machines and particularly to thread tensioning in such machines and more particularly to a thread tensioner that is actuated by a controller to change a tension in the thread, wherein the thread tensioner is sized to be within existing form factors and the controller can actuate the thread tensioner corresponding to a sewing or a non-sewing translation of a workpiece relative to a sewing head.

Description of Related Art

EP1375723 discloses a sewing machine including a cassette mount to which a thread cassette is attached and a method for controlling a thread tension control device therefor, and more particularly to a technique for reliably and desirably adjusting the tension of a thread drawn from the thread cassette when the thread cassette is attached to and detached from the cassette mount.

However, the need exists in sewing and quilting machines for a thread tensioner that automatically changes the tension in the thread. The need further exists for a quilting machine that changes the thread tension corresponding to a sewing translation or a non-sewing translation of a sewing head relative to a workpiece.

SUMMARY OF THE INVENTION

The present disclosure provides a thread tensioner actuated by a controller to change a tension in the thread, wherein the thread tensioner is sized to be within existing form factors and the controller actuates the thread tensioner corresponding to a sewing or a non-sewing translation of a workpiece relative to a sewing head.

In one aspect of the disclosure, a quilting system is provided for selectively imparting a stitch of a thread to a workpiece, the quilting system including a sewing head having a reciprocating needle; a controller connected to the sewing head for controlling reciprocation of the needle; a thread tensioner selectively imparting a tension in the thread prior to engaging the thread engaging workpiece; and an actuator connected to the thread tensioner and the controller, the controller causing the actuator to move between a first position imparting a first tension in the thread and a second position imparting a reduced second tension in the thread. In a further configuration, the controller places the actuator in the second position to impart the second tension in the thread in response to the sewing head moving in a non-sewing translation relative to the workpiece. Also, it is contemplated the controller places the actuator in the first position to impart the first tension in the thread in response to the sewing head moving in a sewing translation relative to the workpiece.

In a further construction, a quilting system is provided having a frame for retaining a workpiece; a carriage mounted to the frame and movable relating to the frame; a sewing head connected to the frame to move with the frame, the sewing head having a reciprocating needle for passing a length of thread into a workpiece during a sewing translation; a thread tensioner connected to the sewing head, the thread tensioner contacting the thread prior to the needle and imparting a tension in the thread and a controller connected to the thread tensioner, the controller causing the thread tensioner to reduce a tension in the thread in response to the sewing head moving relative to the workpiece in a non-sewing translation. It is further contemplated the controller can cause the thread tensioner to maintain a tension in the thread in response to the sewing head moving relative to the workpiece in a sewing translation.

The present disclosure also includes a rotary tension assembly, having a cylindrical housing having a first end and a second end; a post mounted to the housing and extending from the first end of the housing; a tension disk rotatably mounted on the post; a tensioning adjuster connected to the post, the tensioning adjuster moveable between a first position and a second position selectively opposing a rotation of the tension disk in response to positioning of the tensioning adjuster; and an actuator within the housing, the actuator moveable to an interrupt position contacting the tensioning adjuster to reduce an opposition to rotation of the tension disk. In the rotary tension assembly, the actuator is moveable to a standby position, wherein the opposition to rotation of the tension disk corresponds to the position of the tensioning adjuster. Further in the rotary tension assembly, the bias member creates a first opposition to rotation of the tension disk corresponding to the first position of the tensioning adjuster and the bias member creates a reduced second opposition to rotation of the tension disk corresponding to the second position of the tensioning adjuster. In one configuration, the tensioning adjuster includes a bias member.

An alternative configuration provides a rotary tension assembly for a quilting system having a sewing head, the assembly including a tension assembly housing; a tension disk rotatably mounted to the housing; a brake coupled to the tension disk, the brake moveable between a first position providing a first resistance to rotation of the tension disk and a second position providing a reduced second resistance to rotation of the tension disk; an actuator within the housing, the actuator moveable to contact the brake and locate the brake in the second position; and a controller controlling the sewing head, wherein the controller moves the actuator to the second position in response to the sewing head moving relative to a workpiece in a non-sewing translation.

A method is provided including monitoring a relative motion between a workpiece and a quilting sewing head, the relative motion including a sewing translation having an engagement of a thread with the workpiece and a non-sewing translation free from engagement of the thread and the workpiece; and reducing, in response to a signal from a controller, a tension in the thread corresponding to a change in the relative motion from a sewing translation to a non-sewing translation. The method can further include increasing, in response to a signal from a controller, a tension in the thread corresponding to a change in the relative motion from a non-sewing translation to a sewing translation. In the method it is contemplated the signal from the controller is automatically generated by the controller. Further, it is understood the sewing translation includes a reciprocation of a needle and the non-sewing translation is free of a reciprocation of a needle.

In an alternative configuration, the present disclosure includes a rotary thread tensioner having a first disk urged against a length of a thread to apply a pressure to the length of the thread; an actuator connected to the first disk, the actuator movable to a first position reducing a tension in the thread; and a controller connected to the actuator for selectively moving the actuator to the first position to reduce a tension in the thread.

The following will describe embodiments of the present invention, but it should be appreciated that the present invention is not limited to the described embodiments and various modifications of the invention are possible without departing from the basic principle. The scope of the present invention is therefore to be determined solely by the appended claims.

BRIEF DESCRIPTION OF THE DRAWING FIGURES

DETAILED DESCRIPTION OF THE INVENTION

Figure 1:
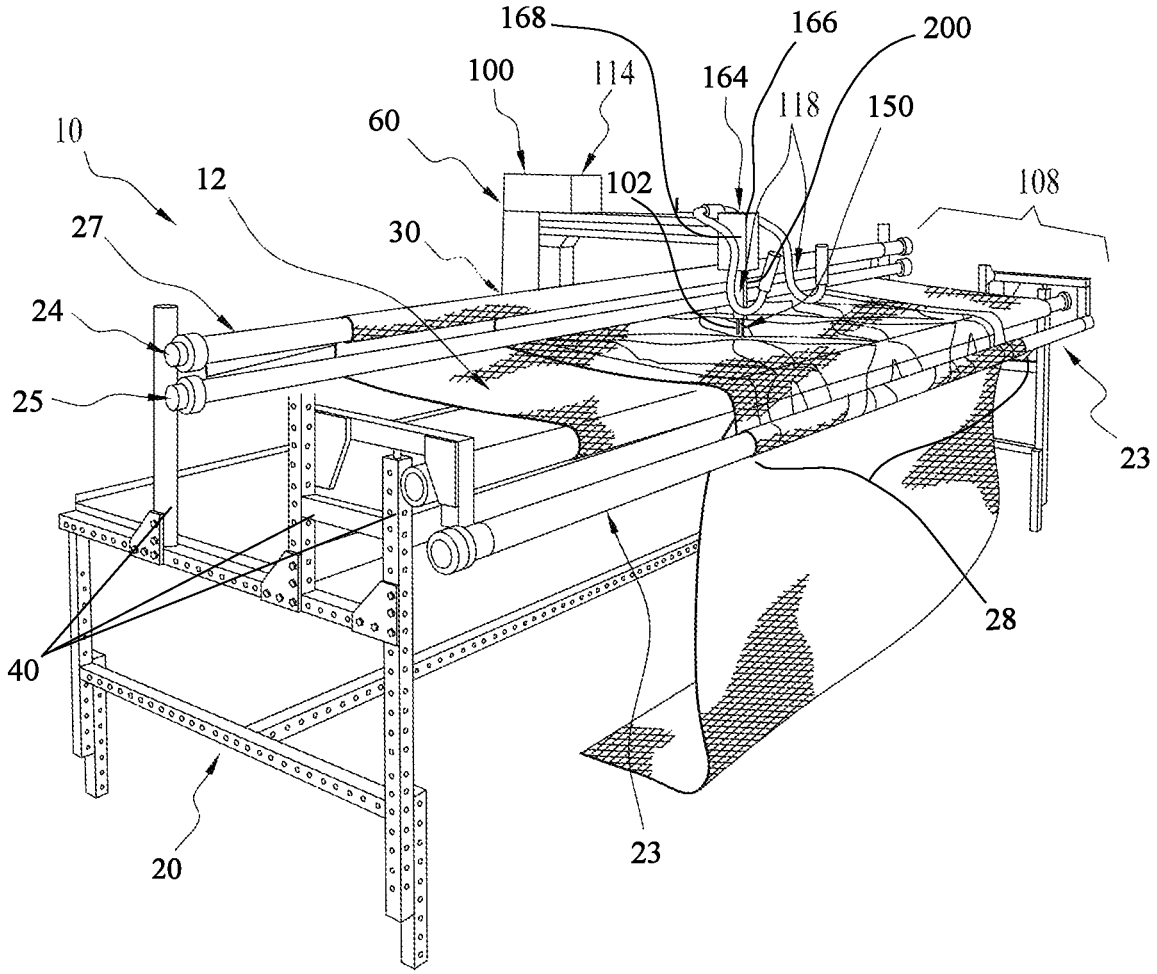
FIG. 1 is a representative quilting machine employing the present automated thread tensioning.

Referring to FIG. 1, shown is a configuration of an exemplary quilting machine 10 that includes a main frame 20, a carriage 30, a sewing machine 100, a support frame 40 for supporting or retaining a textile 12, a thread tensioner 200 and a controller 60.

Although the present description is set forth in terms of a quilting machine 10, the system is not limited to the particular configuration of the quilting machine 10 or a sewing machine.

The term quilting machine 10 encompasses any device for stitching or embroidery of a textile such as but not limited to a machine using digitized patterns with commercially available embroidery software, wherein different types of "fills" can be used to add texture and/or design to the workpiece. The term includes quilting machines for stitching together multiple layers, such as a filler layer between a top and a bottom textile layer, as well as an embroidery machine.

The term textile 12 encompasses any article of manufacture or fabric made by weaving, felting, knitting, crocheting, compressing natural or synthetic fibers. In one configuration, the textile 12 is a quilt. In construction of a quilt it is common to refer to or identify quilt blocks. A quilt block is a small part of a quilt top. A number of quilt blocks together make a quilt. The blocks can be the same, or different from each other. Quilt blocks can be pieced or appliquéd or represent a given portion of the quilt.

The term thread 14 includes a long thin fiber, or a single or multiple fibers, either synthetic or natural, either spun or parallel, which can be used for quilting, sewing or weaving.

The main frame 20 forms a stand or base for supporting the sewing machine 100, the thread tensioner 200, the support frame 40 and typically the controller 60. The main frame 20 can have any of a variety of configurations.

In one configuration of the quilting machine 10, the support frame 40 includes a supply roll assembly 22 and a take up roll assembly 24 which cooperate to define a work piece (textile) retention area 28.

The carriage 30 interconnects the main frame 20 to the sewing machine 100. The interconnection includes a plurality of rollers or slides which permit movement of the sewing machine 100 relative to a textile 12 in the X and Y directions. For purposes of description, the X direction is taken as extending parallel to take-up and supply rollers and the Y direction is perpendicular to the X direction and thus is parallel to the direction along which the textile 12 is wound and unwound.

The interconnection of the carriage 30 and the main frame 20 includes motion sensors such as wheels, rollers or rotation counters, or electrical eyes and markings for providing positioning data to the controller 60. As well known in the art, the motion sensors allow the controller 60 to "know" the position of the sewing machine 100 relative to the support frame 40 (or at least a predetermined reference point or fiducial). Thus, the carriage 30 can be an encoder carriage providing location data to the controller 60.

The support frame 40 provides the textile retention area 28 that retains the textile 12 or portion of the textile relative to the main frame 20 and relative to the sewing machine 100.

The supply roll assembly 22 retains an initial length of textile 12 wound about a supply roller 23. For systems employing a plurality of layers, such quilting having a liner, a filling and a top layer, there may be three supply rollers in the supply roll assembly 22. One of the supply rollers 23 of supply roll assembly 22 is set such that a portion of the periphery defines a line in a plane of operation of the sewing machine 100.

The take up roller assembly 24 includes a bed roller 25 having a portion of the periphery generally coplanar with a portion of the periphery of the supply roller 23 and a take up roller 27 for winding the stitched textile.

The support frame 40 functions to retain a portion of the textile 12 (the work piece) between the line of contact with one of the supply rollers 23 and the bed roller 25 or take up roller 27, if the take up roller compensates for changing diameter of the winding. The supply roll assembly 22 and the take up roll assembly 24 create a tension within the textile 12 between the two assemblies, thereby disposing the intermediate textile in a substantially planar orientation and defining the work piece retention area 28.

Although the present description is set forth in terms of the sewing machine 100 that is moved during stitching relative to a portion of the textile 12 (or work piece), it is understood the textile (work piece) can be moved relative to a fixed sewing machine. Alternatively, both the sewing machine 100 and the textile 12 can be simultaneously moved.

Figure 2:
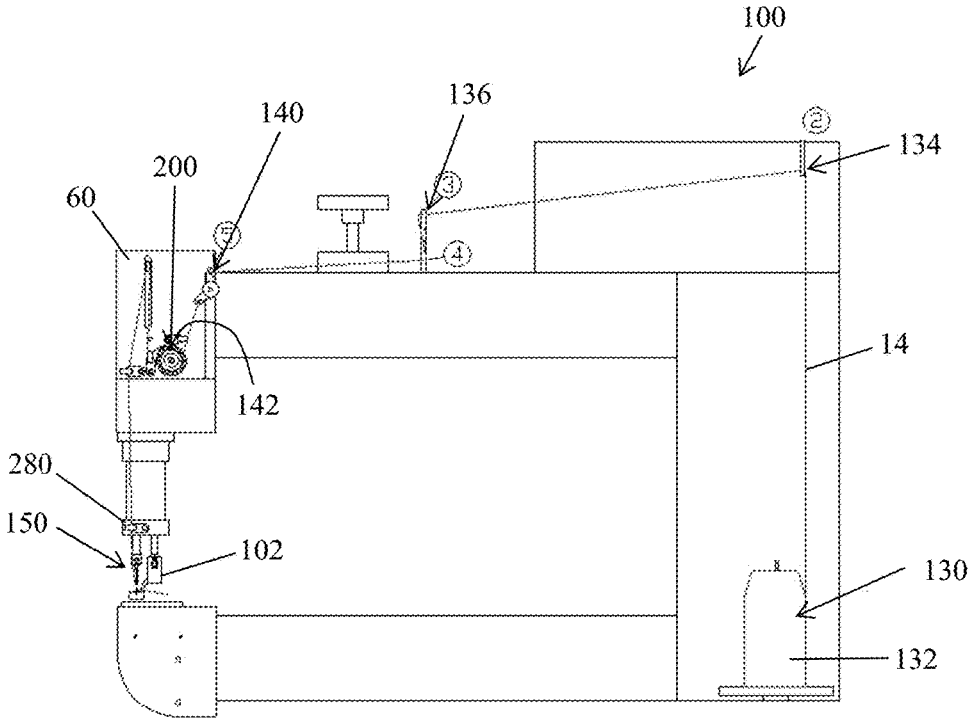
FIG. 2 is a representative portion of a thread path in a quilting machine.

Referring to FIG. 2, the sewing machine 100 includes a sewing head 120 which cooperates with a thread supply 130. The sewing head 120 includes a reciprocating needle 150 moving between a first position above a plane of the work piece retention area 28 and a second position below the plane of the work piece retention area, thereby providing for passage of a portion of reciprocating needle through the textile 12 and selective engaging and passage of a length of thread 14 through the textile.

In selected configurations, the sewing machine 100 includes the controller 60 operably connected to the sewing machine and the thread tensioner 200. The controller 60 includes a processor (or computer) 162, a memory 164, a display 166 and an input 168, such as touch screen, keyboard, key pad and/or mouse. The processor 162 can be a dedicated processor or a programmed processor.

The controller 60 can be physically connected to the main frame 20 or the sewing machine 100. Alternatively, the controller 60 can be a stand-alone device which communicates with the sewing machine 100 and the thread tensioner 200 though a wired or wireless connection. The various configurations set forth accommodate separately manufactured quilting machine 10 and sewing machine 200 or integrated (commonly) assembly quilting machine with the sewing machine.

The controller 60 can control or regulate operation of the sewing machine 100, such as with respect to stitching and creating patterns in the textile 12 as well known in the art. The sewing machine 100 can include a sensor 102 as well known in the art for sensing the position of the needle 150 within the movement cycle of the needle, thereby determining if the needle is engaged with the textile 12 or spaced from the textile. For example, the sensor 102 and hence controller 60 determine when the needle is in the first position and the second position.

In addition, the controller 60 includes or accesses programs for functions including generating, inputting or manipulating patterns. The programs for manipulating the patterns can include line smoothing functions as known in the art and found in Adobe Photoshop program, Xara Xtreme, Artrage, Manga Studio, GIMP or OpenCanvas.

In addition, the controller 60 can control or regulate operation of the thread tensioner 200 to impart or change a corresponding tension in the thread 14, as the thread is passed through the textile 12.

Referring to FIG. 2, presented is an exemplary embodiment of sewing machine 100 defining a thread path from the thread supply 130, such as a cone 132, to the reciprocating needle 150. In this configuration, the thread 14 is supplied on the cone 132 and passes from the cone, through an upper thread guide 134 (often located on a cover of the sewing machine 100). The thread 14 then passes through an upper hole of a thread post 136. The thread 14 exits the thread post 136 through a lower hole. The thread 14 then passes through an upper thread guide of a pre-tension assembly 140. The thread passes to the rotary tension device, or thread tensioner 200. After wrapping about the rotary thread tensioner 200, the thread 14 passes over a check spring 142 and through a first thread guide, a take-up finger and a second thread guide. From the second thread guide, the thread passes through thread guide at the bottom of the reciprocating needle 150, through a needle bar thread guide, located on the end of a needle bar and through an eye of the reciprocating needle.

Figure 3:
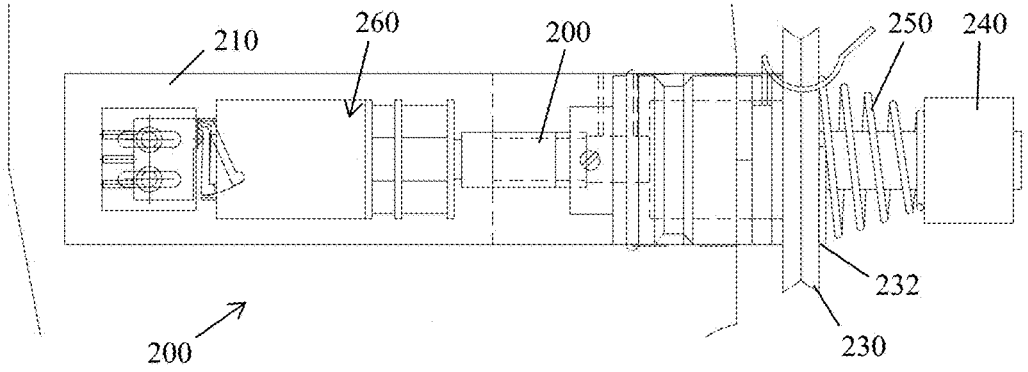
FIG. 3 is an exemplary thread tensioner in accordance with exemplary embodiments of this disclosure.
Figure 4:
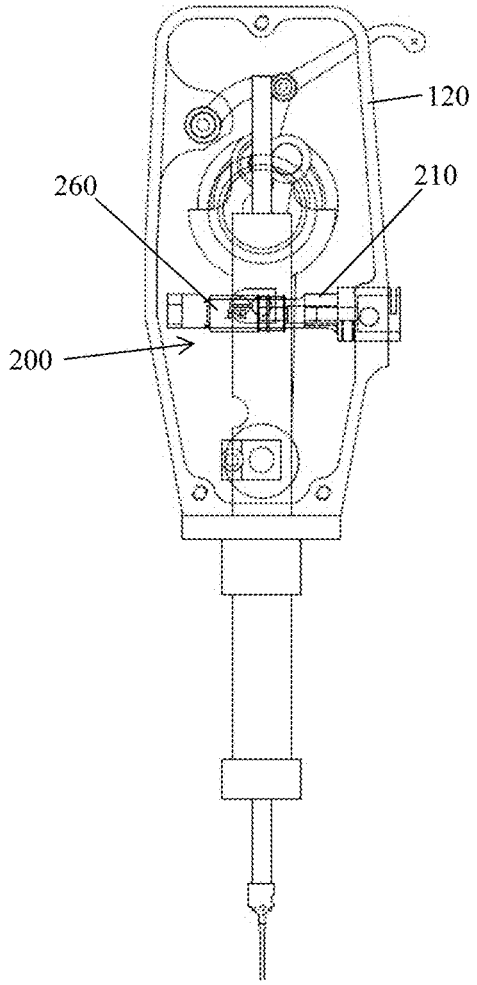
FIG. 4 is a partial cross sectional view of a sewing head with a housing having a motor and actuator for the thread tensioner.
Figure 5:
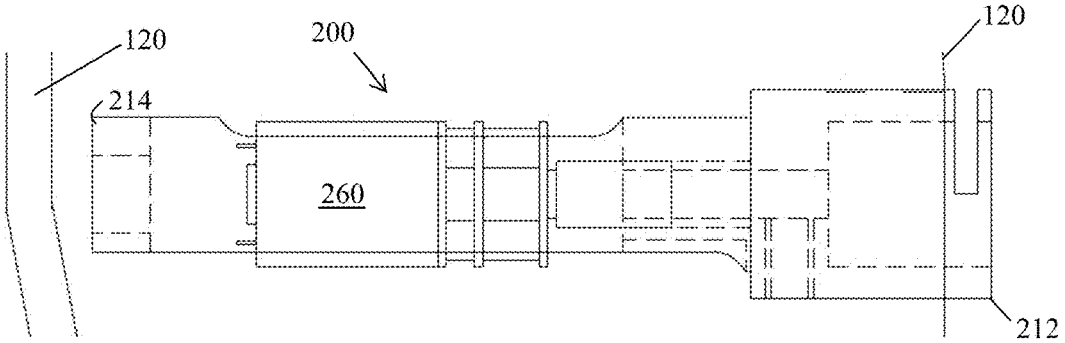
FIG. 5 is an enlarged view of a housing for the thread tensioner including a motor and actuator.

FIG. 3 depicts one exemplary embodiment, wherein the thread tensioner 200 is illustrated as a rotary tensioning assembly, such as a rotary thread tensioner. This configuration of the thread tensioner 200 includes a housing 210, a post 220 mounted to the housing, a tension disk 230 rotatably mounted on the post, a tensioning adjuster 240 connected to the post (such as by a release plate), a bias member 250 between the tensioning adjuster and the tension disk. An actuator 260 is connected to the thread tensioner 200 and the controller 60 for selectively imparting or removing tension to the thread 14, such as in this configuration by reducing the force applied by the bias member 250 to the tension disk 230. As seen in FIG. 4, the thread tensioner 200 can be disposed in the standard location in the sewing machine 100, wherein the portion interfaced by the operator is the same position as a sewing machine without the present system. That is, the present system locates the additional operating components within the preexisting form factor, as shown in FIG. 5.

Figure 6:
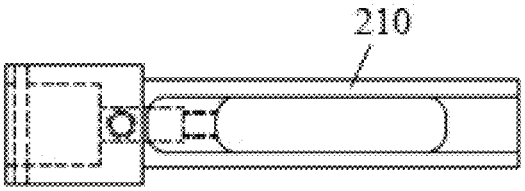
FIG. 6 is a top plan view of the housing of FIG. 5.
Figure 7:
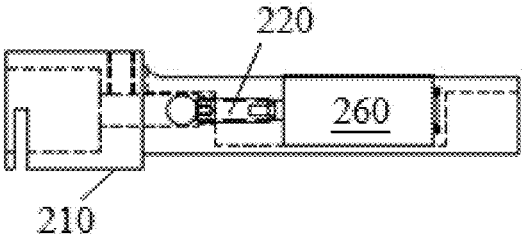
FIG. 7 is a side elevational view of the housing of FIG. 6 with the actuator disposed within the housing.
Figure 8:
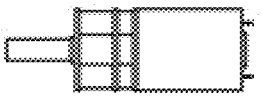
FIG. 8 is top plan view of a motor for an actuator of the thread tensioner.
Figure 9:
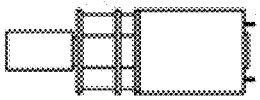
FIG. 9 is a side elevational view of the motor of FIG. 8.

Referring to FIGS. 6 and 7, the housing 210 can be cylindrical and includes a first end 212 and a second end 214 and is sized to fit within the available format factor of the sewing machine 100. Typically, the cylindrical housing 210 has a length between approximately 2.5 inches to 5 inches, with a standard length within the cylindrical housing of between approximately 3 inches to 4 inches. The cylindrical housing 210 has a diameter between approximately one third inches to 1.5 inches. In one configuration, the cylindrical housing 210 has diameter of approximately one inch near the surface of the sewing machine 100 and a diameter of approximately three quarters inch within the sewing machine, the inch diameter extending about 1¼ inches of the length and the diameter of ¾ inch for the remaining length of the cylindrical housing.

As seen in FIG. 3, the tension disk 230 is rotatably mounted relative to the cylindrical housing 210, and in select configurations is rotatably mounted upon the post 220, wherein the post is mounted to and projecting from the cylindrical housing. The post 220 extends from the first end of the cylindrical housing 210.

The tensioning adjuster 240 is connected to the post 220, and is moveable between a first position and a second position. The tensioning adjuster 240 in exemplary embodiments can be a knob threadingly connected to the post 220, such that the knob can be moved longitudinally along the post, thereby selectively increasing or decreasing a distance along a longitudinal dimension between the tensioning adjuster and the tension disk 230.

The bias member 250 is located between the tensioning adjuster 240 and the tension disk 230. The bias member 250 selectively opposes a rotation of the tension disk 230 in response to positioning of the tensioning adjuster 240. Specifically, the bias member 250 acts on the tension disk 230 which changes the available path of the thread 14 and hence increases a tension in the thread. In one configuration, the bias member 250 is a beehive or conical spring. The tension disk 230 thus inhibits passage of a length of thread 14 passed the tension disk 230 and hence to the needle 250. It is also contemplated the release plate 232 can be located intermediate the bias member 250 and the tension disk 230, wherein bias from the bias member is applied to the release plate and the release plate acts upon the tension disk. Thus, movement of the release plate 232 against the bias member 250 reduces (or increases) the load on the tension disk 230 and hence tension in the thread 14.

Although described as separate components, it is understood the tensioning adjuster 240 and the bias member 250 can be incorporated into a single structure. That is, the tensioning adjuster 240 can act directly on the tension disk 230 to change the tension in the thread 14.

Referring to FIGS. 7-15, the actuator 260 is located within the cylindrical housing 210 and moveable to an interrupt position to reduce tension in the thread 14 and a standby position, wherein the applied tension in the thread is changed by the thread tensioner 200. In one configuration, the actuator 260 is moveable to the interrupt position contacting the bias member 250 to reduce an opposition to rotation of the tension disk 230 independent of the tensioning adjuster or position of the tensioning adjuster and to the standby position, wherein the opposition to rotation of the tension disk corresponds to the position of the tensioning adjuster. Alternatively, the actuator 260 can act on the release plate to reduce pressure on the tension disk and hence tension in the thread 14. Conversely, the actuator 260 can be moved to allow the release plate to fully act on the tension disk.

Travel switches 224, 226 can be located intermediate a portion of the housing 210 and the actuator 260. In one configuration, the actuator 260 travels relative to the housing 210 a sufficient distance to actuate at least one of the respective switches. For example, once the actuator 260 has translated the post (or other engaging portions of the actuator), the increased resistance to movement of the engaging portion causes further movement by the actuator to cause the actuator 260 to move relative to the housing 210. This motion of the actuator 260 relative to the housing 210 acts upon at least one of the switches 24, 26. The switches 24, 26 and actuator 260 can be configured with the housing 210 such that both switches are in a common position for a given retracted/extended position of the actuator or both switches are in a different state for the retracted and extended position of the actuator.

In one configuration, the actuator 260 can include a motor or drive 262 and a shaft 264, wherein in a first structure the motor moves the shaft along a longitudinal dimension of the shaft, such as a linear actuator. In a second structure, the motor 262 rotates the shaft 264, wherein the shaft includes gearing for engaging a portion of the actuator 260, such as via a worm gear. The motor 262 can be a stepper motor, operably connected to the controller 60. The actuator 260 is shown in housing 210 in FIGS. 4 and 5.

It is understood in an alternative configuration, the actuator 260 could act on the tension disk 230 to reduce the pressure on the passing length of thread 14. Thus, the actuator 260 would still oppose the bias member 250, but indirectly through the tension disk 230, rather than directly on the bias member.

In one configuration, the actuator 260 is a linear actuator which acts upon the release plate 232, wherein the release plate is disposed intermediate the bias mechanism 250 and the tension disk 230. The linear actuator 260 must be sized to be located within the available form factor of the cylindrical housing 210. The linear actuator 260 can be a piston, screw, worm gear or gear set. The linear actuator 260 can be any of a variety of configurations of a motor driven gear set.

The bias member 250 creates a first opposition to rotation of the tension disk 230 corresponding to the first position of the tensioning adjuster 240 and a reduced second opposition to rotation of the tension disk corresponding to the second position of the tensioning adjuster.

Figure 17:
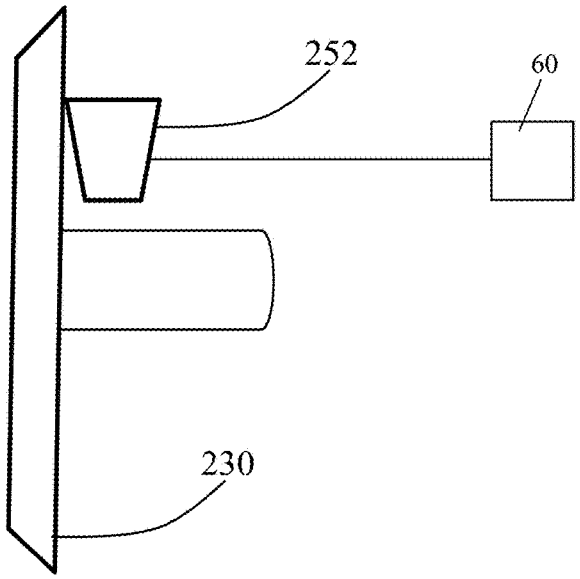
FIG. 17 is a perspective view of an alternative thread tensioner.

In another exemplary embodiment shown in FIG. 17, a brake 252 acts on the tension disk 230 to impart a resistance to rotation of the disk. The brake 252 can operate upon the shaft upon which the tension disk 230 or directly upon the tension disk. Thus, the brake 252 can be used in place of the tensioning adjuster 240 and the bias member 250. The brake 252 is moveable between a first position providing a first resistance to rotation of the tension disk 230 and a second position providing a reduced second resistance to rotation of the tension disk. The actuator 260 or controller 60 acts on the brake 252 to selectively move the brake between the first and the second position to impart a corresponding tension in the thread 14.

In the actuator configuration, the actuator 260 is located within the cylindrical housing 210, and is moveable to contact the brake 252 and locate the brake in the second position. It is contemplated this movement of the brake 252 is controlled by the controller 60.

In the controller configuration, the controller 60 controls the brake 252 to move the brake between the first position and the second position to correspondingly change the tension in the thread 14. For example, if the brake 252 includes a rotating shaft, the controller 60 can control an amount of electricity to a winding operably coupled to the shaft.

Figure 18:
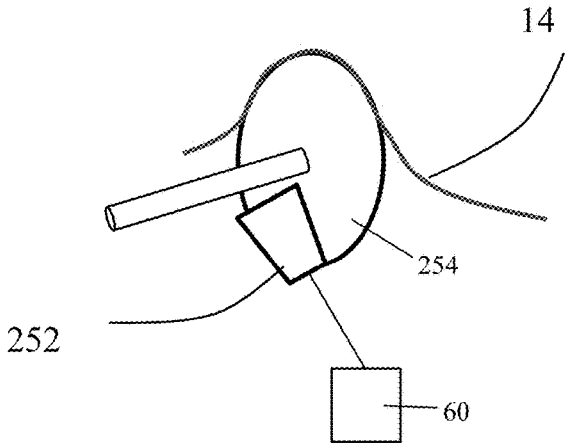
FIG. 18 is a schematic view of a drum/wheel assembly of the thread tensioner.

In an alternative exemplary embodiment, the thread tensioner 200 is in the form of a wheel or pulley 254 as seen in FIG. 18, which rotates corresponding to passage of the thread 14. The rotation of the pulley 254 can be selectively inhibited to increase the tension on the thread 14 or selectively reduced to decrease the tension on the thread. The control of the rotation of the wheel 254 can be accomplished by any of a variety of mechanisms including pressure pads, control of power supply to an inhibiting motor connected to the wheel (of a shaft to the wheel). The controller 60 or actuator 260 can be used to control the rotation of the wheel or pulley and thus regulate the tension in the passing thread.

Figure 19:
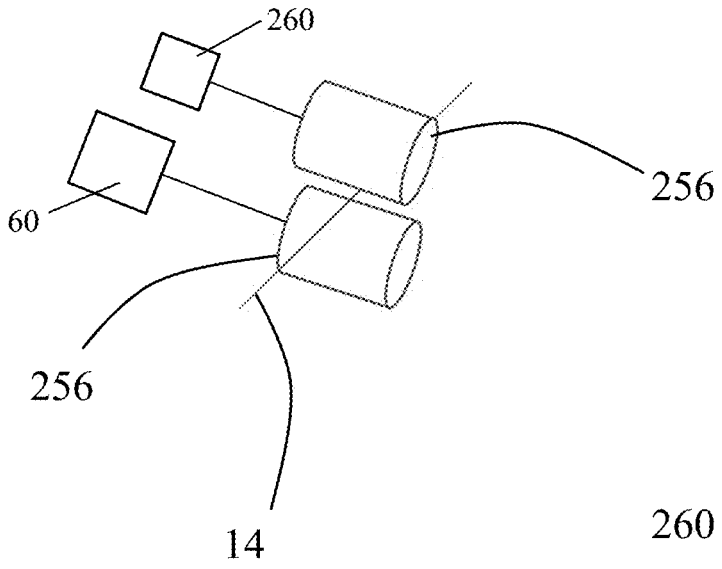
FIG. 19 is a schematic view of a pair of pads/rollers in the thread tensioner for controlling tension in the thread.

In yet a further configuration, opposing pressure pads or rollers 256 shown in FIG. 19, act on a length of the thread 14 (in conjunction with a tension measuring station). The distance between the opposing pressure pads 256 can be provided by the actuator 260 acting on the pads or one of the pads relative to the other. Alternatively, the controller 60 can regulate rotation or placement of the pad/roller 256 relative to the thread 14.

Figure 10:
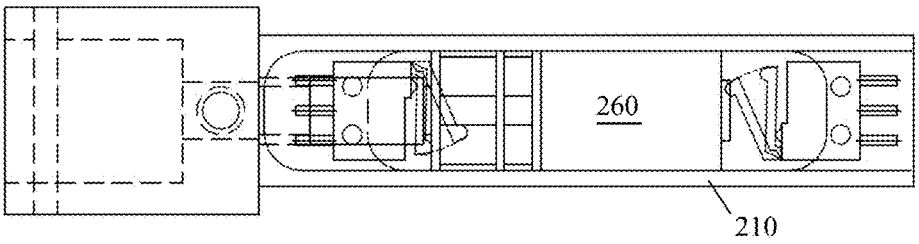
FIG. 10 is a top plan view of the motor of FIG. 8 in a first position in the housing of FIG. 6.
Figure 11:
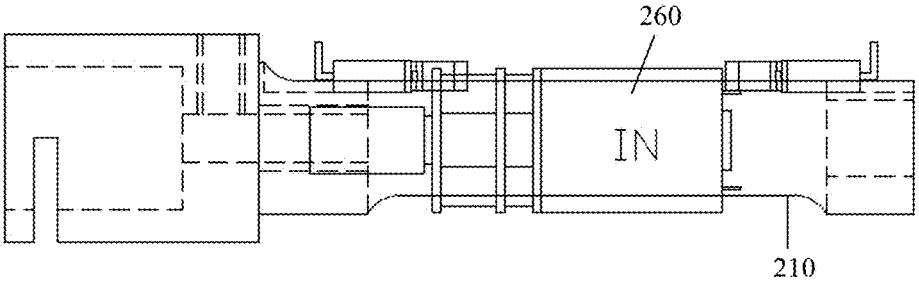
FIG. 11 is a side elevational view of the assembly of FIG. 10 in a first state.
Figure 12:
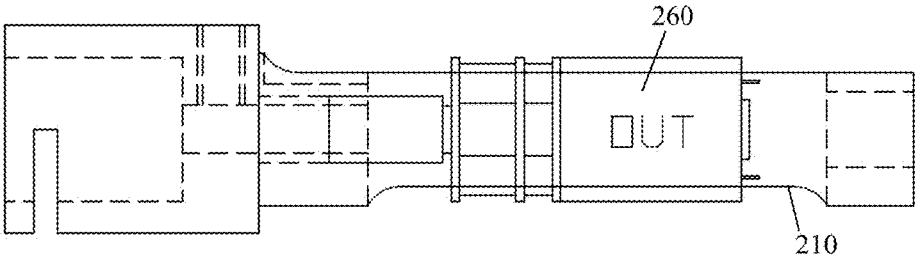
FIG. 12 is a side elevational view of the assembly of FIG. 10 in a second state.
Figure 13:
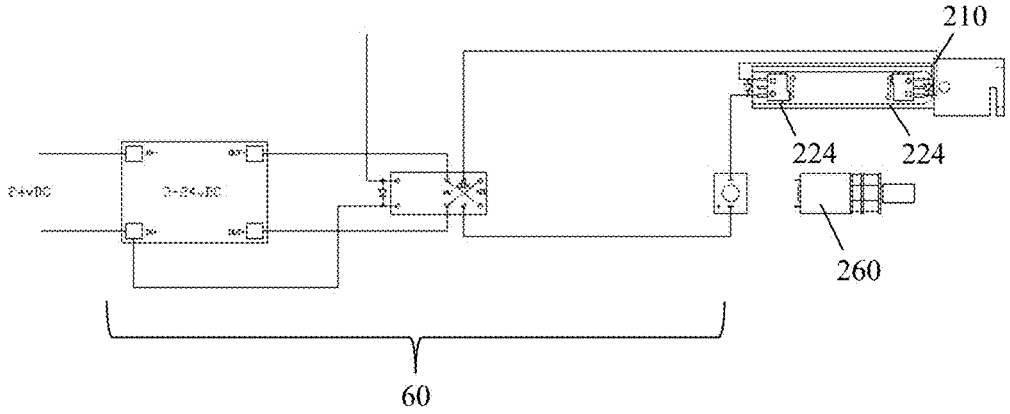
FIG. 13 is a partial schematic of motion limiting switches in the housing of FIG. 5 and the motor of FIG. 8.
Figure 14:
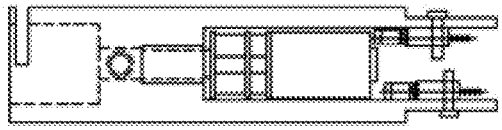
FIG. 14 is a top plan view of a motor and housing assembly of the thread tensioner showing the actuator in a first position in the housing.
Figure 15:
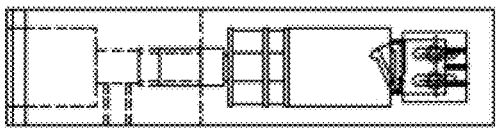
FIG. 15 is a side elevational view of the assembly of FIG. 14 showing the actuator in a second position in the housing.

In select configurations, the actuator 260 cooperates with travel sensors, such as the travel switches 224, 226 shown in FIGS. 10, 14 and 15, wherein the switches are located in the housing 210 and operably connected to the controller 60 as shown in FIG. 13. The switches 224, 226 are activated by the travel of the actuator 260, or position of the actuator relative to the housing 210 and thus the controller 60 can regulate the actuator and hence tension in the thread 14. FIGS. 11 and 12 show the actuator 260 moved relative to the housing 210 between the first position of the actuator and the second position of the actuator.

Additional exemplary embodiments include a tension sensor 280 for sensing a tension or change in tension in the thread 14. The tension sensor 280 can detect the thread tension by means of strain gauges and convert the thread tension into electrical signals to be outputted to the controller 60 or to an amplifier to pass the signals outputted by the sensor to the controller or even a central processor.

In one configuration, the tension sensor 280 is constructed to have the strain gauges at both sides of a plate spring. If a variation in thread tension occurs, the plate spring on which a thread-pressure is applied is correspondingly displaced. Accordingly, a current is outputted by the strain gauges, which is then converted, thereby allowing detection of the thread tension. Thus, the tension sensor 280 can directly detect a variation in thread tension. The tension sensor 280 can be a commercially available axial or inline load cell.

In use, the sewing head 120 is translatable relative to the textile workpiece 12 in either a sewing translation or a non-sewing translation.

In the sewing translation, the needle 150 reciprocates relative to the textile work piece 12 and the thread 14 passes from the thread supply 130 through the thread tensioner 200 and through the needle to be engaged relative to the textile work piece. As well known in the art, the speed (or cycle frequency) of the reciprocating needle 150 is controlled by the controller 60, as a factor of the desired stitch and speed of relative motion between the textile work piece 12 and the sewing head 120 as sensed and used in the prior art.

In the non-sewing translation, the needle 150 is not reciprocating as the sewing head 120 moves relative to the textile work piece 12. That is, the needle 150 is in an up position during non-sewing translation. Non-sewing translations allow the sewing head 120 to be moved to a new location on the textile 12 without forming a stitch trail.

In the configuration employing the tension sensor 280, the controller 60 monitors the tension in the thread 14 and can automatically, without requiring user intervention, cause the thread tensioner 200 to increase or decrease the tension in the thread as necessary to remain within predetermined operating parameters of the sewing machine 100, quilting machine 10 or even thread 14. Thus, the system provides real time sensing of the tension in the thread 14 and real time adjustment of the tension applied to the thread by the thread tensioner.

In practice, when a user operates sewing head 120 a motor of the sewing machine will operate reciprocating needle 150 in an up and down motion. The user will then either move a fabric 12 relative to the sewing head 120 or will move the sewing head relative to the fabric. The thread 14 will pass through the thread tensioner 200 prior to being stitched to the textile as the sewing head 120 operates on the textile. When the user imparts or terminates relative motion between the sewing head 120 and the textile 12, such as by starting or stopping sewing by the sewing head or moving the fabric 12, the actuator 260 moves to an interrupt position to reduce tension in thread from the thread tensioner, such as by contacting the bias member 250 to either reduce or increase an opposition to rotation of the tension disk 230 independent of the tensioning adjuster 240. Thus, the tension on the thread 14 is automatically increased or decreased in response to sewing by the sewing head 120 or movement of the sewing head relative to the textile 12 in the non-sewing translation.

Figure 16:
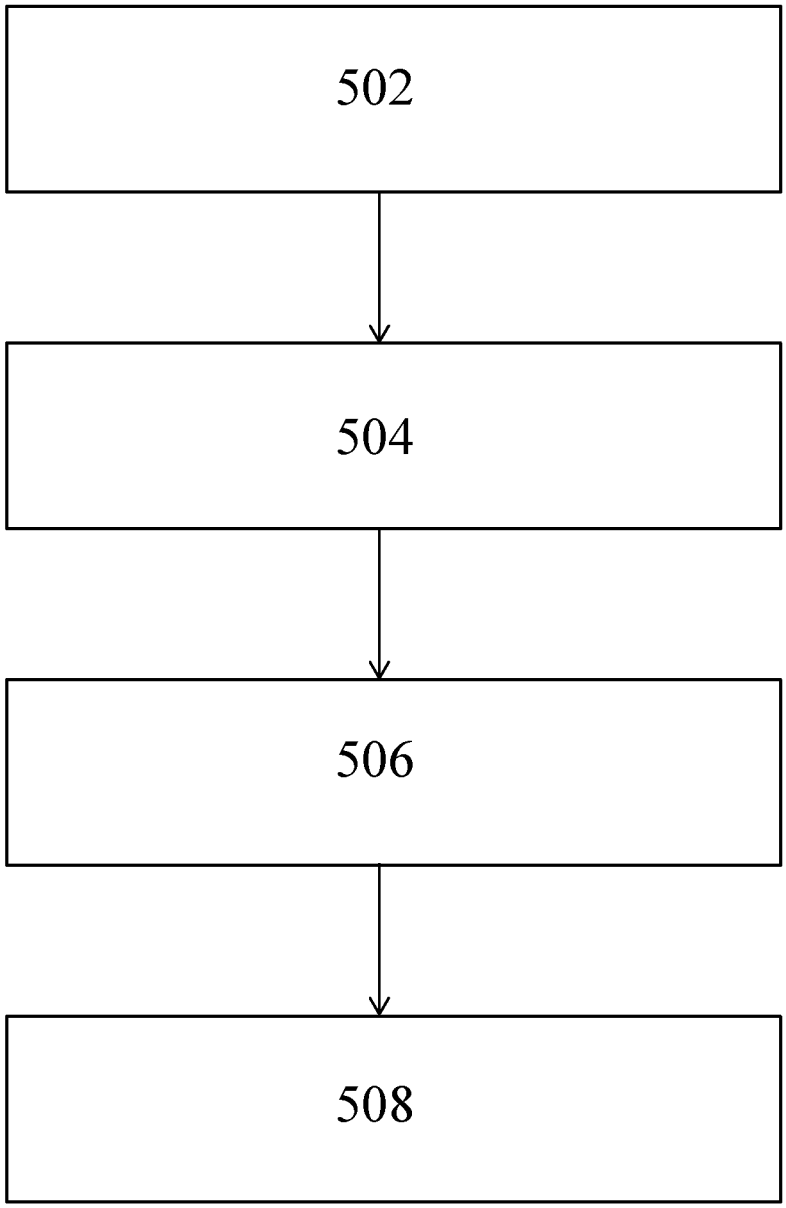
FIG. 16 is a logic flow diagram in accordance with a method, apparatus, and computer-readable medium for performing exemplary embodiments of this disclosure.

FIG. 16 represents a summary of the above teachings for automatic thread tensioning. Block 502 presents monitoring a relative motion between the textile 12 and a sewing head 120, the relative motion including a sewing translation having an engagement of the thread 14 with the textile and a non-sewing translation free from engagement of the thread and the textile; and reducing, in response to a signal from the controller 60, a tension in the thread corresponding to a change in the relative motion between the sewing translation to the non-sewing translation. Further, block 502 includes monitoring a relative motion between a workpiece and a quilting sewing head, the relative motion including a sewing translation having an engagement of a thread with the workpiece and a non-sewing translation free from engagement of the thread and the workpiece; and reducing, in response to a signal from a controller, a tension in the thread corresponding to a change in the relative motion from a sewing translation to a non-sewing translation. Block 504 specifies further comprising increasing, in response to a signal from the controller 60, tension in the thread 14 corresponding to a change in the relative motion between the non-sewing translation and the sewing translation. Further, block 504 includes further comprising increasing, in response to a signal from a controller, a tension in the thread corresponding to a change in the relative motion from a non-sewing translation to a sewing translation. Block 506 includes wherein the signal from the controller is automatically generated by the controller and block 508 includes wherein the sewing translation includes a reciprocation of a needle.

Thus, the present system provides for the thread tension to be adjusted in response to a change in the motion of sewing or the sewing head 120.

The logic diagram of FIG. 16 may be considered to illustrate the operation of a method, and a result of execution of computer program instructions stored in a computer-readable memory, and a specific manner in which components of an electronic device are configured to cause that electronic device to operate, whether such an electronic device is a quilting machine, sewing machine, computer, or some other device, or one or more components thereof. The various blocks shown in FIG. 13 may also be considered as a plurality of coupled logic circuit elements constructed to carry out the associated function(s), or specific result of strings of computer program instructions or code stored in a memory.

Various embodiments of the computer-readable medium or computer-readable memory include any data storage technology type which is suitable to the local technical environment, including but not limited to semiconductor based memory devices, magnetic memory devices and systems, optical memory devices and systems, fixed memory, removable memory, disc memory, flash memory, dynamic random-access memory (DRAM), static random-access memory (SRAM), electronically erasable programmable read-only memory (EEPROM) and the like. Various embodiments of the processor include but are not limited to general purpose computers, special purpose computers, microprocessors, digital signal processors and multi-core processors.

Thus, the present system includes a quilting system for selectively imparting a stitch of a thread to a workpiece, the system having a sewing head having a reciprocating needle; a controller connected to the sewing head for controlling reciprocation of the needle; a thread tensioner imparting a tension in the thread prior to the thread engaging the workpiece; and an actuator connected to the thread tensioner and the controller, the controller causing the actuator to move between a first position corresponding to the thread tensioner imparting a first tension in the thread and a second position corresponding to the thread tensioner imparting a reduced second tension in the thread.

In the quilting system, the controller can place the actuator in the second position to impart the second tension in the thread in response to the sewing head moving in a non-sewing translation relative to the workpiece. Further in the quilting system, the controller can place the actuator in the second position to impart the second tension in the thread in response to the sewing head moving in a non-sewing translation relative to the workpiece. Also in the quilting system, the controller can place the actuator in the first position to impart the first tension in the thread in response to the sewing head moving in a sewing translation relative to the workpiece.

Alternatively, the quilting system can include a frame for retaining a workpiece; a carriage mounted to the frame and movable relative to the frame; a sewing head connected to the carriage to move with the carriage, the sewing head having a reciprocating needle for passing a length of thread into a workpiece during a sewing translation, the sewing head moveable relative to the workpiece in the sewing translation and a non-sewing translation; a thread tensioner connected to the sewing head, the thread tensioner contacting the thread prior to the reciprocating needle and imparting a tension in the thread; and a controller connected to the thread tensioner, the controller causing the thread tensioner to reduce a tension in the thread in response to the sewing head moving relative to the workpiece in the non-sewing translation.

In such quilting system, the controller can cause the thread tensioner to maintain a tension in the thread in response to the sewing head moving relative to the workpiece in the sewing translation.

A method is provided including the steps of monitoring a relative motion between a workpiece and a quilting sewing head, the relative motion being one of a sewing translation having an engagement of a thread with the workpiece and a non-sewing translation free from engagement of the thread and the workpiece; and reducing, in response to a signal from a controller, a tension in the thread corresponding to a change in the relative motion from the sewing translation to the non-sewing translation.

The method can further include increasing, in response to a signal from a controller, a tension in the thread corresponding to a change in the relative motion from the non-sewing translation to the sewing translation. In the method, the signal from the controller can be automatically generated by the controller. Also in the method, the sewing translation can include a reciprocation of a needle. Further in the method, the non-sewing translation can be free of a reciprocation of a needle.

While a preferred embodiment of the invention has been shown and described with particularity, it will be appreciated that various changes in design and formulas and modifications may suggest themselves to one having ordinary skill in the art upon being apprised of the present invention. It is intended to encompass all such changes and modifications as fall within the scope and spirit of the appended claims.

The invention claimed is:

1. An apparatus comprising:

(a) a housing having a first end and a second end and sized to be partly received within a sewing head;

(b) a post mounted to the housing and moveable along an axial direction relative to the housing between a first position and a second position;

(c) a tension disk operable to rotate relative to the post;

(d) a tensioning adjuster moveable between a first location and a second location, the second location being longitudinally further from the tension disk than the first location;

(e) an actuator at least partly within the housing; and (f) a bias member located between the tensioning adjuster and the tension disk, the bias member operable to oppose a rotation of the tension disk in response to a location of the tensioning adjuster, wherein the bias member creates a first opposing force to rotation of the tension disk at the first location of the tensioning adjuster, and wherein the bias member creates a contributing to the greater second opposing force to rotation of the tension disk at the second location of the tensioning adjuster, and wherein the actuator is moveable to an interrupt position reducing the second opposing force to rotation of the tension disk.

2. The apparatus of claim 1, wherein the actuator is moveable to a standby position, wherein the opposition to rotation of the tension disk corresponds to the position of the tensioning adjuster.

3. The apparatus of claim 1, wherein the tensioning adjuster includes a bias member.

4. The apparatus of claim 1, wherein the housing is cylindrical.

5. The apparatus of claim 1, wherein the interrupt position reducing the second opposing force to rotation of the tension disk is independent of the position of the tensioning adjuster.

6. An apparatus comprising:

(a) a tension assembly housing sized to be received within a sewing head;

(b) a tension disk mounted to the tension assembly housing, the tension disk operable to rotate with respect to the tension assembly housing;

(c) a brake coupled to the tension disk, the brake operable to oppose a rotation of the tension disk, the brake moveable between a first position providing a first resistance to rotation of the tension disk and a second position providing a greater second resistance to rotation of the tension disk;

(d) an actuator within the tension assembly housing, the actuator moveable to reduce resistance to rotation of the tension disk; and (e) a controller controlling movement of a needle relative to the sewing head, wherein the controller moves the actuator to the second position in response to the sewing head moving relative to a workpiece in a sewing translation.

7. The apparatus of claim 6, further comprising a controller controlling movement of a needle relative to the sewing head, wherein the controller moves the actuator to the first position in response to the sewing head moving relative to a workpiece in a non-sewing translation.

8. The apparatus of claim 6, wherein the brake includes a spring.

9. The apparatus of claim 6, wherein the actuator acts upon the brake.

10. The apparatus of claim 6, wherein the actuator acts upon the tension disk.

11. The apparatus of claim 6, wherein the actuator movable to locate the brake in the first position.

12. An apparatus comprising:

(a) a rotary thread tensioner in a sewing head, the rotary thread tensioner having a first disk operable to rotate with variable resistance to rotation to a contacting a length of a thread;

(b) an actuator operably coupled to the first disk, the actuator movable to a first position decreasing a resistance to rotation of the rotatable first disk and imparting a reduced tension in the thread; and (c) a controller connected to the actuator for selectively moving the actuator to the first position to decrease the resistance to rotation of the rotatable first disk and impart a reduced tension in the thread, wherein the controller controls movement of a needle relative to the sewing head, wherein the controller moves the actuator to the first position in response to the sewing head moving relative to a workpiece in a non-sewing translation.

13. The apparatus of claim 12, wherein the controller controls movement of a needle relative to the sewing head, wherein the controller moves the actuator to a second position placing a greater tension in the thread than the first position in response to the sewing head moving relative to a workpiece in a sewing translation.

14. The apparatus of claim 12, wherein the actuator is connected to the disk.

* * * * *